US006786305B2

(12) United States Patent
Kamimura et al.

(10) Patent No.: US 6,786,305 B2
(45) Date of Patent: Sep. 7, 2004

(54) DOUBLE-DECK ELEVATOR

(75) Inventors: Kosei Kamimura, Fuchu (JP); Ikuo Asami, Wako (JP)

(73) Assignee: Toshiba Elevator Kabushiki Kaisha, Tokyo-To (JP)

( * ) Notice: Subject to any disclaimer, the term of this patent is extended or adjusted under 35 U.S.C. 154(b) by 242 days.

(21) Appl. No.: 10/031,328

(22) Filed: May 6, 2002

(65) Prior Publication Data

US 2002/0134623 A1 Sep. 26, 2002

(30) Foreign Application Priority Data

May 18, 2000 (JP) ..... 2000-145901

(51) Int. Cl.[7] ..... B66B 9/00; B66B 7/00
(52) U.S. Cl. ..... 187/314; 187/902; 187/401
(58) Field of Search ..... 187/249, 277, 187/285, 401, 414, 902, 284, 291

(56) References Cited

U.S. PATENT DOCUMENTS

| | | | | | |
|---|---|---|---|---|---|
| 5,220,981 | A | * | 6/1993 | Kahkipuro et al. | 187/249 |
| 5,907,136 | A | * | 5/1999 | Hongo et al. | 187/277 |
| 6,161,652 | A | * | 12/2000 | Kostka et al. | 187/291 |
| 6,334,511 | B1 | * | 1/2002 | Araki | 187/380 |
| 6,336,522 | B1 | * | 1/2002 | Fujita et al. | 187/380 |
| 2003/0024772 | A1 | * | 2/2003 | Naitoh | 187/401 |
| 2003/0164266 | A1 | * | 9/2003 | Gallati et al. | 187/284 |

FOREIGN PATENT DOCUMENTS

| | | | | |
|---|---|---|---|---|
| EP | 0 870 716 | | 10/1998 | |
| FR | 2 645 135 | | 10/1990 | |
| JP | 04072288 | A * | 3/1992 | B66B/11/02 |
| JP | 04223985 | A * | 8/1992 | B66B/1/40 |
| JP | 04303378 | A * | 10/1992 | B66B/1/14 |
| JP | 06191773 | A * | 7/1994 | B66B/11/02 |
| JP | 7-041267 | | 2/1995 | |
| JP | 8-208158 | | 8/1996 | |
| JP | 48-76242 | | 10/1997 | |
| JP | 10-279231 | | 10/1998 | |
| WO | 01 00519 | | 1/2001 | |

* cited by examiner

*Primary Examiner*—Jonathan Salata
(74) *Attorney, Agent, or Firm*—Oblon, Spivak, McClelland, Maier & Neustadt, P.C.

(57) ABSTRACT

A double-decker elevator includes a winch, an upper car, a lower car, a car support frame supporting the upper and lower car, a car space adjusting device capable of adjusting the space between the upper and lower car, and an emergency operation controller. When the car space adjusting device is unable to operate normally, the emergency operation controller operates the winch to move the car support frame such that the upper and lower car are located sequentially at positions corresponding to adjacent floors, respectively.

25 Claims, 7 Drawing Sheets

DOUBLE-DECK ELEVATOR

BACKGROUND OF THE INVENTION

1. Field of the Invention

The present invention relates to a double-deck elevator provided with two cars and a car space adjusting device for adjusting the space between the cars so that the space between the cars is substantially equal to the story height. More specifically, the present invention relates to techniques for quickly rescuing passengers from a car of an elevator when a car space adjusting device or a winch malfunctions.

2. Description of the Related Art

A double-deck elevator provided with a double-deck car unit having upper and lower cars is often installed in a skyscraper for efficient space utilization and for improving transporting performance. A double-deck elevator disclosed in JP-A No. Sho 48-76242 is designed for use in a building having floors arranged with irregular story height difference. This prior art double-deck car unit is provided with a car space adjusting device that adjusts the space between the upper and the lower cars so that the platforms of the upper and the lower cars are able to be leveled with adjacent floors simultaneously.

The upper and the lower car are supported on a car support frame. A winch moves the car support frame supporting the upper and the lower car vertically. When the car support frame is stopped at a predetermined position corresponding to destination floors, the car space adjusting device adjusts the space between the upper and the lower car according to the story height between the adjacent floors. In some cases, the car space adjusting operation of the car space adjusting device for adjusting the space between the upper and the lower car is performed simultaneously with the car support frame moving operation of the winch for vertically moving the car support frame.

Passengers are locked up in the cars if the car space adjusting device or the winch malfunctions due to some trouble. If such a trouble occurs, the passengers locked up in the double-deck elevator must weight until a serviceman assigned to the inspection and maintenance of the double-deck elevator arrives at the site and rescues the passengers. The passengers locked up in the upper and the lower car will wish to be rescued quickly.

SUMMARY OF THE INVENTION

It is an object of the present invention to provide a double-deck elevator enabling the quick rescue of passengers locked up in the cars when the car space adjusting device or the winch malfunctions.

To attain the objective, the present invention provides a double-deck elevator, which includes: a car support frame; a winch for vertically moving the car support frame; a first car supported on the car support frame and provided with a door; a second car supported on the car support frame and provided with a door; a car space adjusting device mounted on the car support frame and capable of adjusting a space between the first and the second car according to a floor height difference between two adjacent floors, to which the first and the second cars are to be landed; and an emergency operation controller that monitors the condition of the car space adjusting device and, when the car space adjusting device is unable to operate normally, operates the winch in order to move the car support frame vertically such that the first car and the second car are located at positions corresponding to a first floor and a second floor, to which the first and the second cars are able to be landed, respectively, and opens and closes the doors of the first and the second cars, according to at least one predetermined operating procedure.

Preferably, the at least one operating procedures includes two operating procedures. The emergency operation controller compares a floor height difference between the first and the second floors and a distance between upper surfaces of platforms of the first and the second car, and selects either one of the two operating procedures according to a result of comparison.

One of the two operating procedures may include the steps of moving the car support frame such that the platform of the first car is leveled with the first floor and the platform of the second car is not leveled with the second floor or such that the platforms of both the first and the second cars are not leveled with the first and the second floors, respectively and opening the doors of both the first and the second cars.

Another operating procedure of the two operating procedures may include the steps of moving the car support frame such that the platform of the first car is leveled with the first floor, opening the door of the first car, closing the door of the first car, moving the car support frame such that the platform of the second car is leveled with the second floor, and opening the door of the second car.

If it is impossible to determine the floor height difference between the first and the second floors and the distance between the platforms of the first and the second cars, an operating procedure may include the steps of moving the car support frame such that the platform of the first car is leveled with the first floor, opening the door of the first car, closing the door of the first car, moving the car support frame such that the platform of the second car is leveled with the second floor and opening the door of the second car.

The present invention also provides a double-deck elevator, which includes a car support frame; a winch for vertically moving the car support frame; a first car supported on the car support frame and provided with a door; a second car supported on the car support frame and provided with a door; a car space adjusting device mounted on the car support frame and capable of adjusting a space between the first and the second car according to a floor height difference between two adjacent floors, to which the first and the second cars are to be landed; and an emergency operation controller that monitors the condition of the car space adjusting device and, when the car space adjusting device is unable to operate normally, operates the winch in order to move the car support frame vertically such that the first car is landed to a floor and the second car is landed to a floor.

Furthermore, the present invention provides a double-deck elevator, which includes: a car support frame; a winch for vertically moving the car support frame; a first car supported on the car support frame and provided with a door; a second car supported on the car support frame and provided with a door; a car space adjusting device mounted on the car support frame and capable of adjusting a space between the first and the second car according to a floor height between two adjacent floors, to which the first and the second cars are to be landed; and an emergency operation controller that monitors the condition of the winch and, when the winch is unable to operate normally, operates the car space adjusting device to move the first car and the second car vertically such that the first and the second cars are located at positions corresponding to a first floor and a second floor, to which the first and the second cars are landed, respectively, and opens and closes the doors of the first and the second cars.

BRIEF DESCRIPTION OF THE DRAWINGS

The above and other objects, features and advantages of the present invention will become more apparent form the following description taken in connection with the accompanying drawings, in which.

DESCRIPTION OF THE PREFERRED EMBODIMENTS

Figure 1:
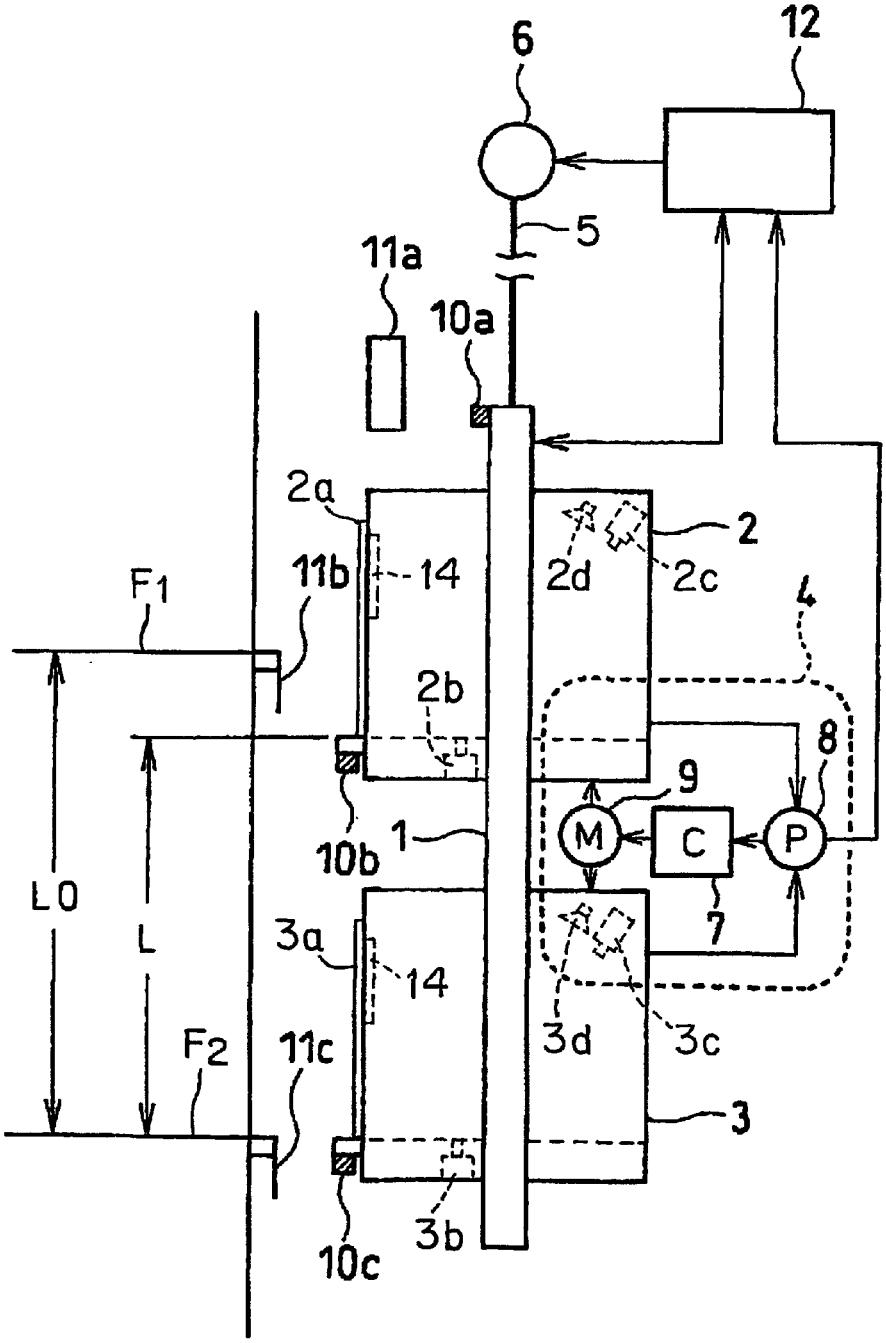
FIG. 1 is a schematic side elevation of a double-deck elevator in a first embodiment according to the present invention.

Preferred embodiments of the present invention will be described hereinafter with reference to the accompanying drawings.

First Embodiment

A double-deck elevator in a first embodiment according to the present invention will be described with reference to FIGS. 1 to 5.

An upper car 2 provided with a door 2*a* and a lower car 3 provided with a door 3*a* are supported on a car support frame 1. A car space adjusting device 4 is capable of vertically moving the cars 2 and 3 on the car support frame 1 to adjust the space between the cars 2 and 3 according to the floor height difference $L_0$ between adjacent floors $F_1$ and $F_2$ such that the floors of the cars 2 and 3 are leveled with destination floors $F_1$ and $F_2$, respectively. The car space adjusting device 4 may be capable of driving the cars 2 and 3 for individual movement, i.e., independent movement or may be capable of simultaneously moving the cars 2 and 3 respectively in opposite directions. The car support frame 1 is suspended on hoist cables 5 from a winch 6. The car support frame 1 is moved vertically by the winch 6 to move the upper car 2 and the lower 3 simultaneously vertically.

The car space adjusting device 4 is provided with a controller 7. The controller 7 controls a motor 9 to adjust the positional relation between the cars 2 and 3 such that platform distance L, i.e., distance between the upper surfaces of the platforms of the cars 2 and 3, is substantially equal to the floor height difference $L_0$ between the destination floors $F_1$ and $F_2$.

The car support frame 1, the upper car 2 and the lower car 3 are provided with photoelectric device 10*a*, 10*b* and 10*c*, respectively. Landing floor indicating plates 11*a*, 11*b* and 11*c* are disposed in a shaft (hoistway), through which the car support frame 1 is moved, at positions to which the photoelectric devices 10*a*, 10*b* and 10*c* correspond, respectively, upon the arrival of the cars 2 and 3 at the floors $F_1$ and $F_2$, respectively. The car space adjusting device 4 moves the cars 2 and 3 on the basis of information provided by the photoelectric devices 10*a*, 10*b* and 10*c* to level the platforms of the cars 2 and 3 with the destination floors $F_1$ and $F_2$, respectively.

The car space adjusting device 4 adjusts the space between the cars 2 and 3 so that the platform distance L between the platforms of the cars 2 and 3 coincides with the floor height difference $L_0$ between the destination floors $F_1$ and $F_2$, which is a fixed value specified for the building in which the double-deck elevator is installed, after the car support frame 1 has been stopped with the cars 2 and 3 corresponding respectively with the floors $F_1$ and $F_2$ and the photoelectric device 10*a* of the car support frame 1 has detected the landing floor indicating plate 11*a*. Upon the positional coincidence of the photoelectric device 10*b* and 10*c* of the cars 2 and 3 with the landing floor indicating plates 11*b* and 11*c*, respectively, the doors 2*a* and 3*a* of the cars 2 and 3 are opened. The foregoing operating procedure is controlled and executed by an operation controller (normal operation controller), not shown.

The floor distance L is adjusted after the car support frame 1 has stopped as mentioned above or while the car support frame is being moved vertically. In most cases, the landing floor indicating plate 11*a* to be detected by the photoelectric device 10*a* of the car support frame 1 is disposed at the middle position between the adjacent floors. In FIG. 1, the photoelectric device 10*a* is disposed in an upper part of the car support frame 1 and the landing floor indicating plate 11*a* is located so as to correspond to the photoelectric device 10*a* when the cars 2 and 3 have arrived at the adjacent floors, respectively, for simplicity.

The double-deck elevator shown in FIG. 1 is provided with an emergency operation controller 12. The emergency operation controller 12 may be either included in or independent of the aforesaid normal operation controller, not shown. The emergency operation controller 12 has at least a trouble detecting function to detect the malfunction of the car space adjusting device 4, such as the malfunction of the motor 9, a winch control function to control the winch 6 and a door control function to control the doors 2*a* and 3*a* of the cars 2 and 3. Data on the platform distance provided by a sensor 8 included in the car space adjusting device 4 is give to the emergency operation controller 12. The term, "malfunction of the car space adjusting device 4" signifies not only a state where the car space adjusting device 4 is unable t function at all but also a state where the car space adjusting device 4 is able to operate but unable to operate normally.

Figure 2:
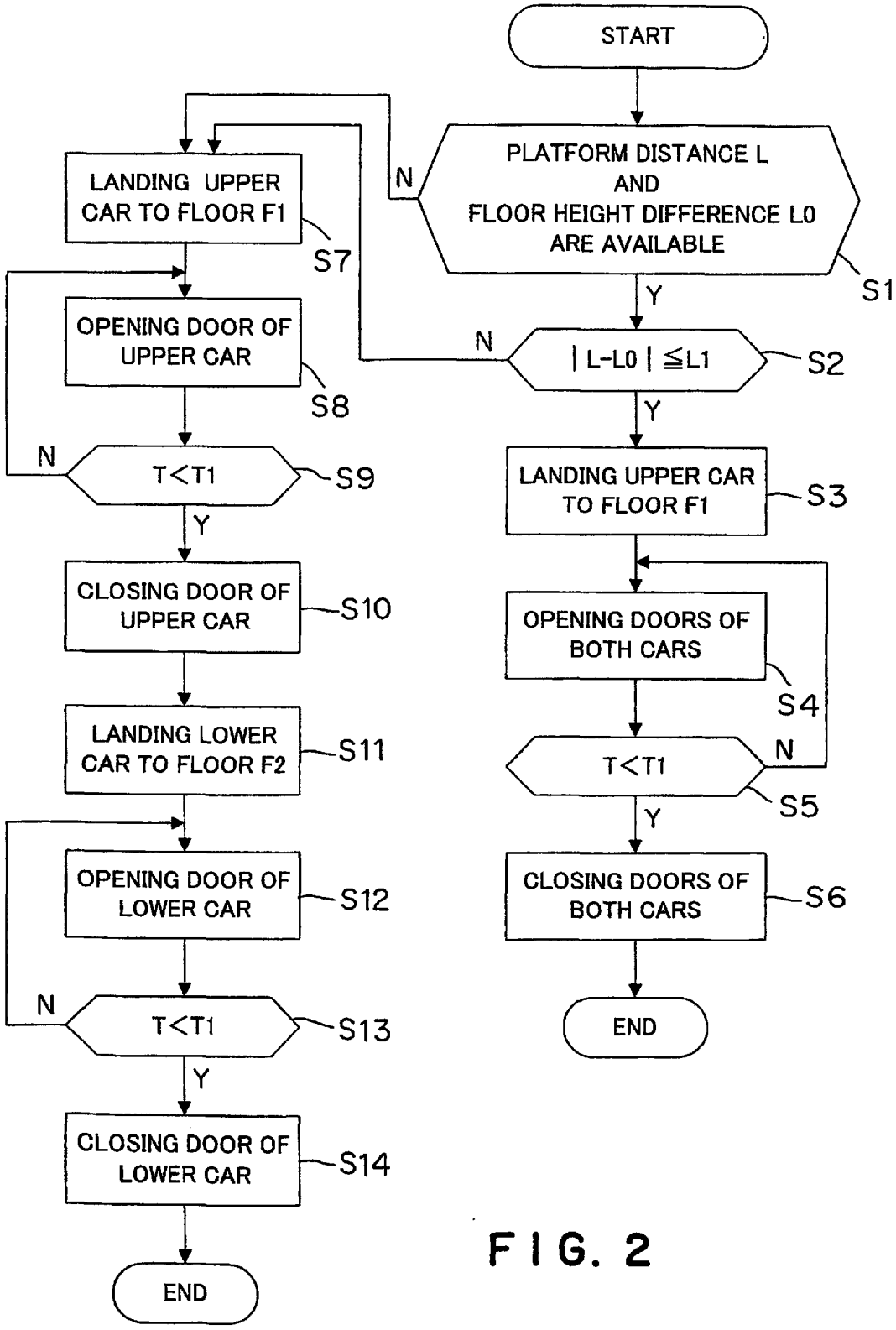
FIG. 2 is a flow chart of a procedure for an emergency rescue operation to be carried out by an emergency operation controller included in the double-deck elevator shown in FIG. 1.

A rescue operation procedure to be carried out under the control of the emergency operation controller 12 will be described with reference to a flow chart shown in FIG. 2. The following description will be made on an assumption that the car space adjustment by the car space adjusting device 4 is performed after the car support frame 1 has stopped.

Suppose that the emergency operation controller 12 found that the car space adjusting device 4 is unable to operate normally after the car support frame 1 has stopped at a stopping position for stopping the cars 2 and 3 at the destination floors $F_1$ and $F_2$ The emergency operation controller 12 makes a query in step S1 to see whether the data on the platform distance L can be obtained from sensor 8 of the car space adjusting device 4 and whether data on the floor height difference $L_0$ between the destination floors $F_1$ and $F_2$ is available. Usually, the data on the floor height between the destination floors $F_1$ and $F_2$ is stored in a storage device included in the emergency operation controller 12 or the normal operation controller. Cases where the data on the floor height $L_0$ between the destination floors $F_1$ and $F_2$ is unavailable includes a case where the data stored in the storage device is lost and a case where the emergency operation controller 12 is unable to fetch the data from the storage device of the normal operation controller.

When the data on the platform distance L and the floor height difference $L_0$ are available, the emergency operation controller 12 compares the data on the platform distance L and the floor height difference $L_0$ to see if $|L-L_0| \leqq L_1$, where $L_1$ is a predetermined value, in step S2. The value $L_1$ is 500 mm because a difference of 500 mm in height between the floor and the car does not cause passengers inconvenience when the passengers get out of the car.

When $|L-L_0| \leqq L_1$, the emergency operation controller 12 actuates the winch 6 to move the car support frame 1 so that platform of the upper car 2 is leveled with the destination floor $F_1$ in step S3.

Then in step S4, the emergency operation controller 12 opens the doors 2*a* and 3*a* of the cars 2 and 3. Although the platform of the lower car 3 is not leveled with the destination floor $F_2$ in this state, the lower car 3 does not cause passengers getting out of the lower car 3 any inconvenience because the difference in height between the platform of the lower car 3 and the destination floor $F_2$ is 500 mm or below.

In step S5, the emergency operation controller 12 measures time T elapsed after the doors 2*a* and 3*a* have been opened and compares the time T with predetermined time $T_1$ and keeps the doors 2*a* and 3*a* open until the time exceeds the predetermined time $T_1$. The passengers get out of the cars 2 and 3 while the doors 2*a* and 3*a* are kept open. The predetermined time $T_1$ is sufficient for the passengers to get out of the cars 2 and 3; preferably, the predetermined time $T_1$ is 5 min. After the predetermined time $T_1$ has elapsed, the emergency operation controller 12 closes the doors 2*a* and 3*a* of the cars 2 and 3 in step S6 to complete a rescue operation.

In step S4, the car support frame 1 may be positioned such that the platform of the lower car 3 is leveled with the destination floor $F_2$ or such that a difference in height between the platform of the upper car 2 and the destination floor $F_1$ and that in height between the platform of the lower car 3 and the destination floor $F_2$ are approximately equal. However, such a method of locating the cars 2 and 3 makes the use of the photoelectric devices and the landing floor indicating plates difficult and therefore it is preferable to level the platform of either of the cars 2 and 3 with the corresponding floor. Floors on which the cars 2 and 3 are to be landed are not limited to the destination floors $F_1$ and $F_2$ but may be landed on the floors near the destination floors $F_1$ and $F_2$.

When it is decided in step S1 that at least either the data on the platform distance L or the data on the floor height $L_1$ is unavailable or when it is decided in step S2 that $|L-L_0|>L_1$, steps S7 to S14 are executed to land the cars 2 and 3 are landed separately on the floors, respectively.

In such a case, the emergency operation controller 12 drives the winch 6 to move the upper car 2 to the destination floor $F_1$ in step S7 and to level the platform of the upper car 2 with the destination floor $F_1$ by using the photoelectric device 10*b* and the landing floor indicating plate 11*b*.

Subsequently, the emergency operation controller 12 opens the door 2*a* of the upper car 2 in step S8 and keeps the door 2*a* open until the predetermined time $T_1$ (5 min) elapses. Upon the detection of elapse of the predetermined time $T_1$ in step S9, the door 2*a* is closed in step S10. The door 3*a* of the lower car 3 is kept closed during the execution of steps S8 to S10.

Then the emergency operation controller 12 controls the winch 6 to move the lower car 3 to the destination floor $F_2$ in step S11. The platform of the lower car 3 is leveled with the destination floor $F_2$ by using the photoelectric device 10*c* and the landing floor indicating plate 11*c*.

Subsequently, the emergency operation controller 12 opens the door 3*a* of the lower car 3 in step S12 and keeps the door 3*a* open until it is decided in step S13 that the predetermined time $T_1$ has elapsed. The passengers get out of the car 3 in the predetermined time $T_1$. Upon the detection of elapse of the predetermined time $T_1$ in step S13, the door 3*a* is closed in step S14. The door 2*a* of the car 2 is kept closed after the execution of Step S10. Thus a rescuer operation is accomplished.

The cars 2 and 3 are not necessarily to be landed at the initial destination floors $F_1$ and $F_2$ but may be landed on any possible floors.

It is preferable to take measures to prevent the passengers once left the cars 2 and 3 from returning into the cars 2 and 3 by mistake or to prevent other passengers from entering the cars 2 and 3 after the passengers have left the cars 2 and 3. Therefore it is desirable to provide the double-deck elevator with a device for advising the passengers acoustically and/or visually not to enter the cars 2 and 3. As shown in FIG. 1, the cars 2 and 3 are provided with loudspeakers 2*d* and 3*d* to advice the passengers not to enter the cars 2 and 3. The emergency operation controller 12 operates the loudspeakers 2*d* and 3*d* to continue advising the passengers not to enter the cars 2 and 3 until the doors 2*a* and 3*a* are closed after the passengers have left the cars 2 and 3. A decision as to whether or not any passengers are still in the cars 2 and 3 is made on the bases of signals provided by load measuring devices 2*b* and 3*b* disposed under the platforms of the cars 2 and 3. When load W on the platforms of the cars 2 and 3 is not greater than a predetermined weight $W_1$, preferably, 30 kg, it is decided that the cars 2 and 3 are empty.

Figure 3:
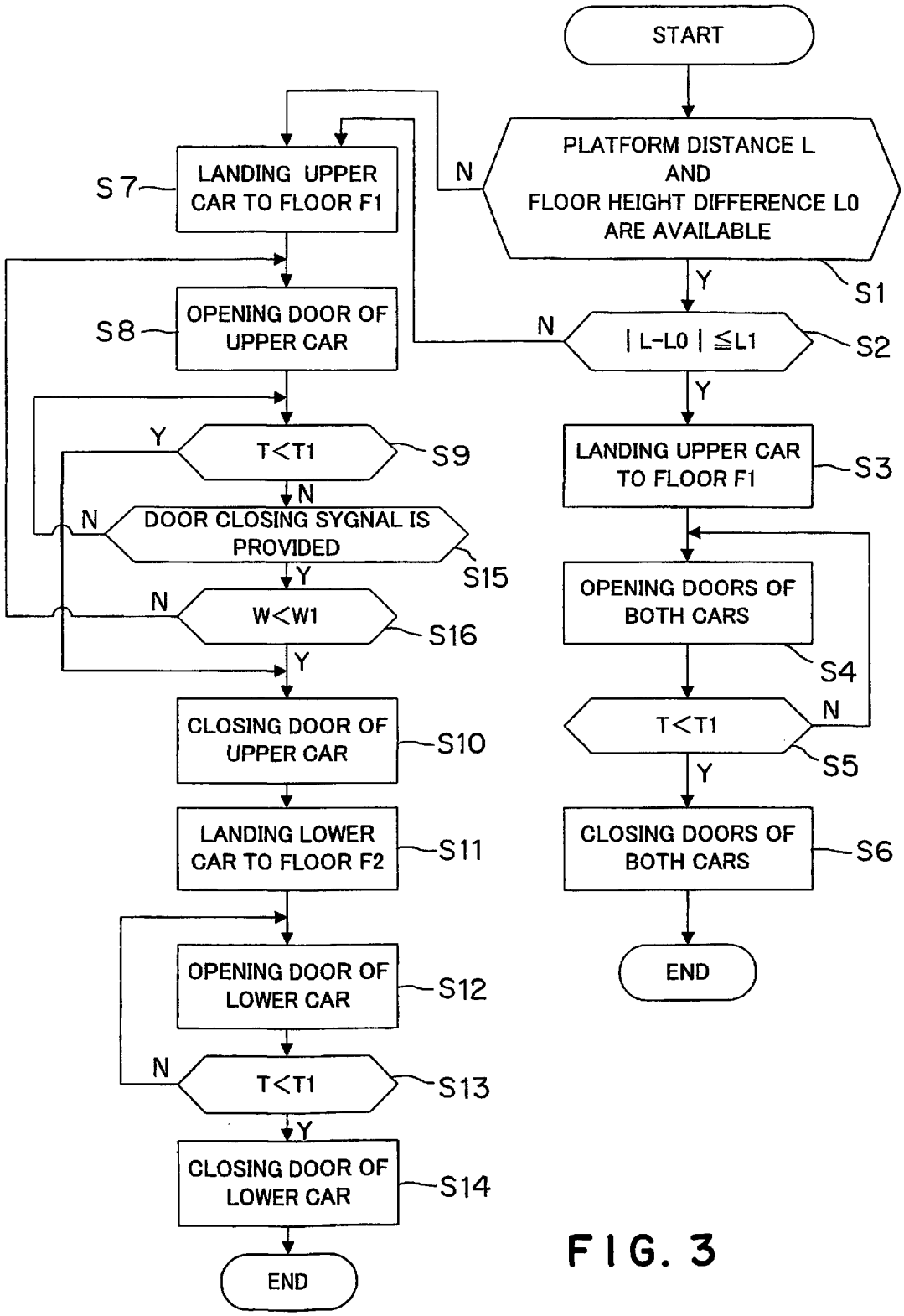
FIG. 3 is a flow chart of a procedure in a modification of the procedure represented by the flowchart shown in FIG. 2.

Another rescue operation procedure to be carried out by the emergency operation controller 12 will be describe with reference to a flow chart shown in FIG. 3. The rescue operation procedure shown in FIG. 3 has, in addition to the steps of the rescue operation procedure shown in FIG. 2, steps S15 and S16. Therefore steps of the rescue operation procedure shown in FIG. 3 corresponding to those of the rescue operation procedure shown in FIG. 2 are denoted by the same step numbers and the description thereof will be omitted to avoid duplication.

The winch 6 is controlled to move the upper car 2 to the nearest floor in step S7 and the door 2*a* of the car 2 is opened in step S8. In step S9, a query is made to see whether time T elapsed after the door 2*a* was opened has exceeded the predetermined time $T_1$. If the time T is shorter than the predetermined time $T_1$, a query is made in step S15 to see whether a door closing signal is provided by the lower car 3. If the response to the query in step S15 is affirmative, the it is decided in step S16 whether or not any passengers exist in the upper car 2 on the basis of a signal provided by the load measuring device 2*b* of the car 2. If no passenger is on the upper car 2, the door 2*a* is closed and a rescue operation for the passengers of the lower car 3 is started in step S10. If any passengers exist on the upper car 2, the procedure returns to step S8. This rescuer operation procedure minimizes stress that may be induced in the passengers locked up in the lower car 3 and waiting for rescue.

The cars 2 and 3 are provided with emergency door closing buttons 19 to be operated to send out the door closing signal during the rescue operation. The emergency door closing buttons 19 are placed on car-station panels 14 shown in FIG. 5, respectively.

Although the emergency operation procedure shown in FIG. 3 executes the rescue operation for rescuing the passengers on the upper car 2 first, the rescue operation for rescuing the passengers on the lower car 3 may be started first.

Figure 4:
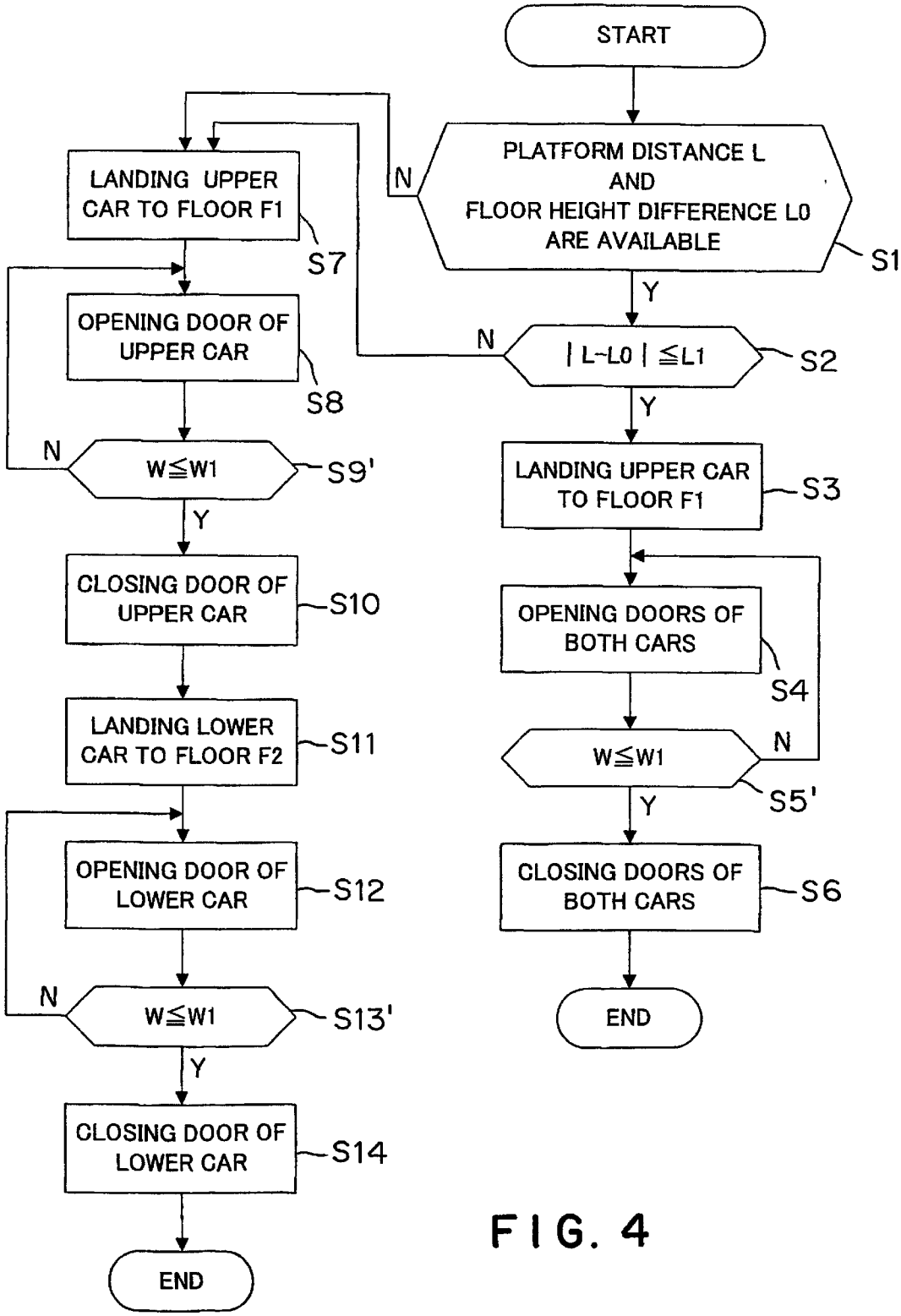
FIG. 4 is a flow chart of a procedure in another modification of the procedure represented by the flow chart shown in FIG. 2.

A third rescue operation procedure to be carried out by the emergency operation controller 12 will be describe with reference to a flow chart shown in FIG. 4. The rescue operation procedure shown in FIG. 4 has steps S5', S9' and S13' instead of the steps of the rescue operation procedure shown in FIG. 2. Therefore the same step numbers denotes steps of the rescue operation procedure shown in FIG. 4 corresponding to those of the rescue operation procedure shown in FIG. 2 and the description thereof will be omitted to avoid duplication. Whereas the rescue operation procedure shown in FIG. 2 decides that all the passengers have left the car upon the elapse of the predetermined time after the door was opened, the rescue operation procedure decides that all the passengers have left the car when a passenger detecting means does not detect any passenger.

A decision as to whether or not any passengers are still in the cars 2 and 3 is made similarly to that in step S16 of the rescue operation procedure shown in FIG. 3 on the basis of the load W measured by the load measuring devices 2*b* and 3*b* disposed under the platforms of the cars 2 and 3. The rescue operation procedure shown in FIG. 4, as compared with that shown in FIG. 2, is able to complete the rescue operation for rescuing the passengers locked up in the car for which the rescue operation is performed first in a shorter time and is able to start the rescue operation for the other car earlier.

The means for detecting the passengers on the cars are not limited to the load measuring devices 2*b* and 3*b*, the cars 2 and 3 may be provided with TV cameras 2*c* and 3*c* for detecting the passengers. Video signals provided by the TV cameras 2*d* and 3*d* are give to an image processing device (not shown), the image processing device decides whether or not any passengers are left in the cars, and the decision of the image processing device is sent to the emergency operation controller 12. Man sensors may be installed in the cars 2 and 3 to detect the passengers in the cars.

A means for providing information about the progress of the rescue operation for the passenger during the rescue operation will be described with reference to FIG. 5.

Figure 5:
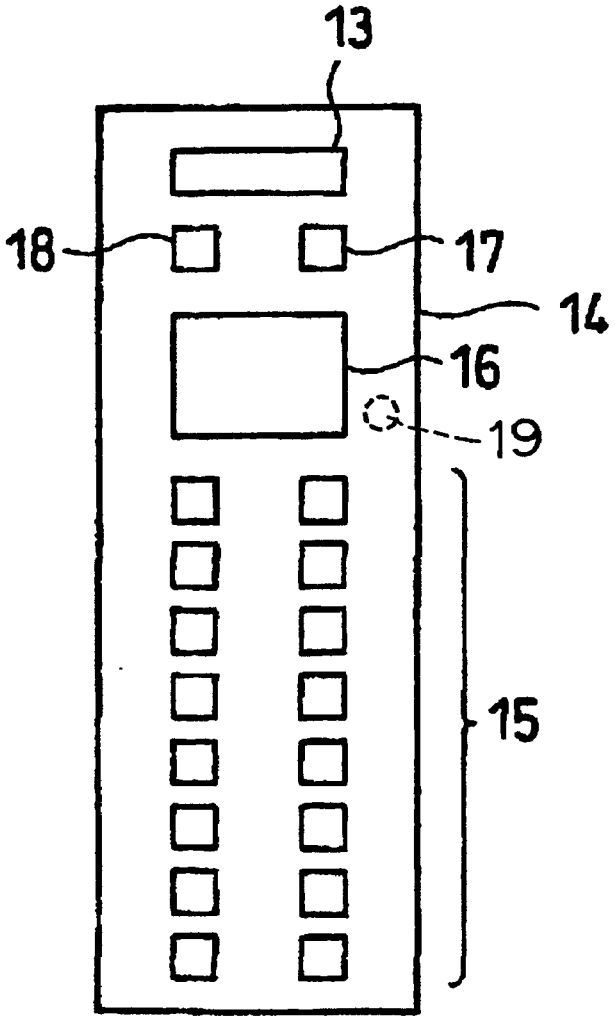
FIG. 5 is a plan view of a car-station panel attached to a wall of a car.

FIG. 5 is a plan view of the car-station panel 14 set on a wall of each of the cars 2 and 3. The car-station panel 14 is provided with floor selector buttons 15, a position indicator 16 for indicating a present position, a door open button 17 for keeping the door open during the normal operation and a door close button 18 for closing the door during the normal operation. The car-station panel 14 of the car 2 (car 3) is provided with a display 13 for displaying information about the progress of the rescue operation for the other car 3 (car 2).

The display 13 of the car 2 (car 3) displays information about the progress of the rescue operation in process for the car 3 (car 2) while the car 2 (car 3) is waiting for the rescue operation. For example, messages "Moving the car", "Passengers of the upper car are getting out of the car" and the like are displayed. The passengers are prevented from getting into a panic by providing the passengers with accurate information about the rescue operation to give the passengers a sense of security.

Second Embodiment

A double-deck elevator in a second embodiment according to the present invention will be described with reference to FIGS. 6 and 7. The double-deck elevator in the second embodiment is the same in configuration and function as the double-deck elevator in the first embodiment, except that the operation of an emergency operation controller 12 included in the former is different from that of the emergency operation controller 12 of the latter. When a winch 6 included in the second embodiment malfunctions, the emergency operation controller 12 drives a car space adjusting device 4 for a rescue operation.

Figure 6:
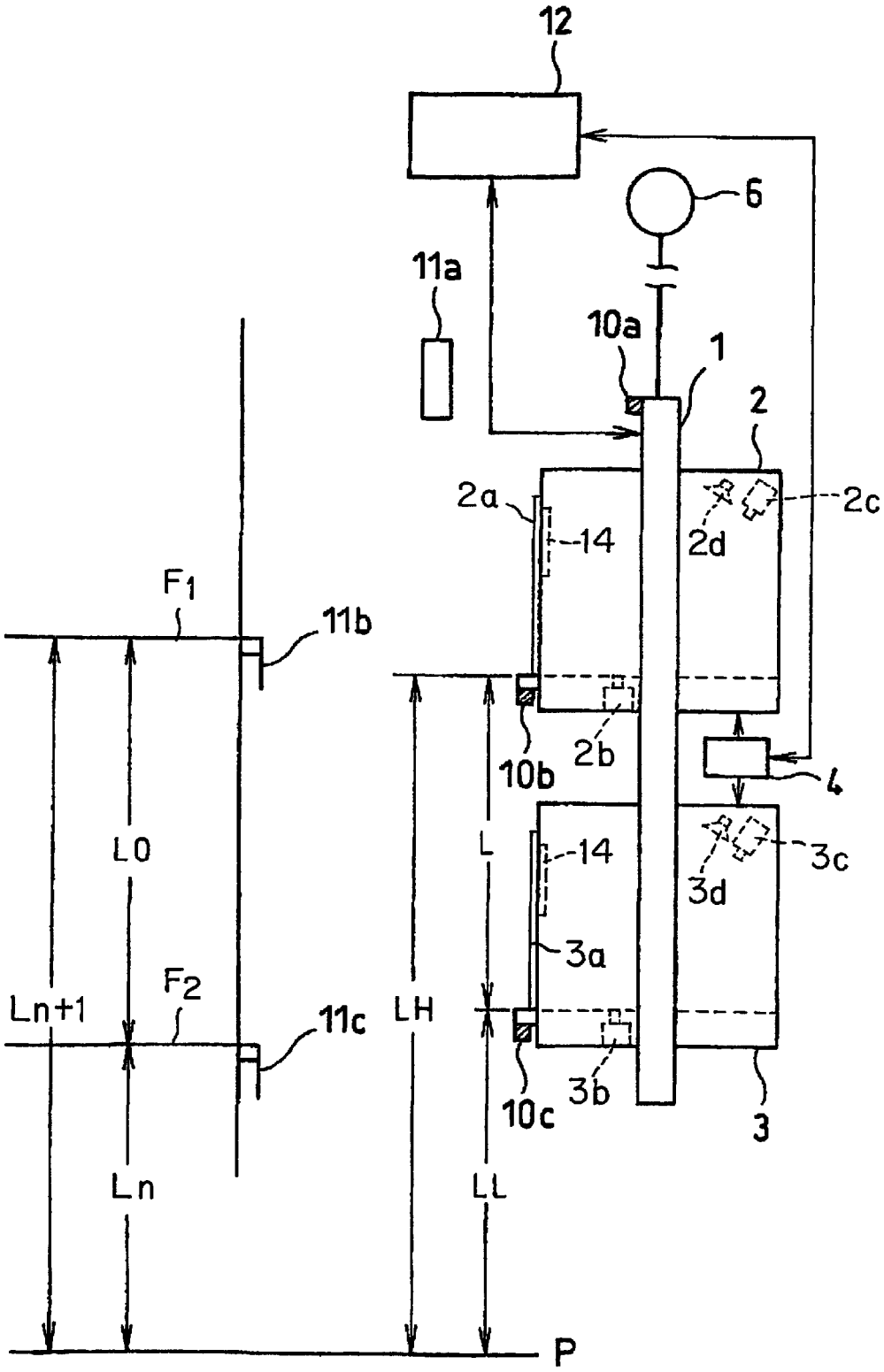
FIG. 6 is a schematic side elevation of a double-deck elevator in a second embodiment according to the present invention.

FIG. 6 shows a condition the double-deck elevator immediately after the winch 6 has malfunctioned and a car support frame 1 has stopped. In FIG. 6, a symbol LL indicates the height of the platform of a lower car 3 from a reference plane P, a symbol LH indicates the height of the platform of an upper car 2 from the reference plane P, a symbol $L_n$ indicates the height of a floor $F_2$ the nearest to the lower car 3, a symbol $L_{n+1}$ indicates the height of a floor $F_1$ the nearest to the upper car 2 from the reference plane P, a symbol $L_0$ indicates the floor height between the floor $F_2$ the nearest to the lower car 3 and the floor $F_1$ the nearest to the upper car 2, and a symbol L indicates the distance between the platforms of the cars 2 and 3.

When the winch 6 went wrong, the emergency operation controller 12 examines the heights LH and LL of the cars 2 and 3, and the heights $L_{n+1}$ and $L_n$ of the floors $F_1$ and $F_2$ and decides whether or not the car space adjusting device 4 can achieve a rescue operation. If a rescue operation for both the cars 2 and 3 or a rescue operation for either the upper car 2 or the lower car 3 is possible, the emergency operation controller 12 drives the car space adjusting device 4 to carry out a rescue operation. If a rescue operation by the car space adjusting device 4 is impossible, the emergency operation controller 12 waits for external rescue operations. FIG. 7 shows a control procedure that is carried out by the emergency operation controller 12 when the winch 6 malfunctions.

Figure 7:
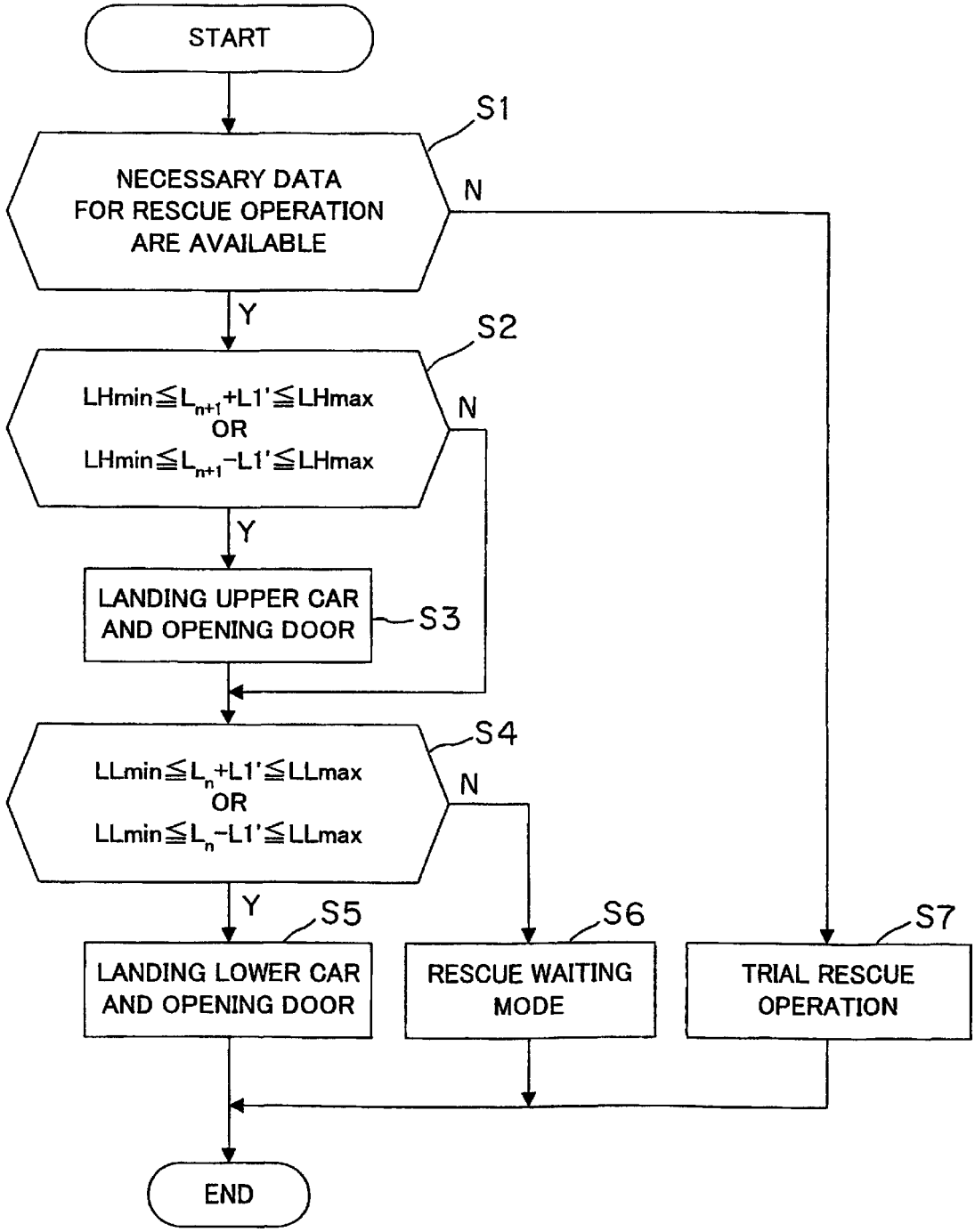
FIG. 7 is a flow chart of a procedure for an emergency rescue operation to be carried out by an emergency operation controller included in the double-deck elevator shown in FIG. 6.

Referring to FIG. 7, upon the detection of the malfunction of the winch 6, the emergency operation controller 12 decides whether or not data necessary for rescue operations for rescuing passengers in the cars 2 and 3 is available in step S1. The data necessary for rescuing operations includes the heights LH and LL of the cars 2 and 3 from the reference plane P and the heights $L_{n+1}$ and $L_n$ of the floors $F_1$ and $F_2$ the nearest to the cars 2 and 3, respectively.

When the data is available, the emergency operation controller 12 decides whether or not a rescue operation for the upper car 2 is feasible in step S2. Suppose that the upper car 2 can be vertically moved by the car space adjusting device 4, the upper limit height of a height range in which the upper car 2 can be moved is $LH_{max}$ and the lower limit height of the same is $LH_{min}$. Then, if the height $L_{n+1}$ of the floor $F_1$ the nearest to the upper car 2 is in the height range between $LH_{max}$ and $LH_{min}$, the upper car 2 can be landed on the nearest floor $F_1$. As mentioned above in connection with the description of the first embodiment, even if the platform of the car is not perfectly leveled with the floor, the difference in height between the floor and the car does not cause passengers inconvenience when the passengers get out of the car, provided that the absolute value $L_1'$ of the difference in height between the platform of the car and the floor is 500 mm or below. Thus, practically, the door 2*a* of the upper car 2 can be opened to let the passengers get out of the car 2 if $LH_{min} \leqq L_{n+1}+L_1' \leqq LH_{max}$ or $LH_{min} \leqq L_{n+1}-L_1' \leqq LH_{max}$.

If this condition is satisfied, the car space adjusting device 4 is made to operate to land the upper car 2 on the floor $F_1$ and the door 2*a* of the upper car 2 is opened in step S3. Timing of closing the door 2*a* is determined according to the method mentioned above in connection with the description of the first embodiment. If this condition is not satisfied, any rescue operation is performed for the upper car 2 and a rescue operation for the upper car 2 is left to the work of maintenance servicemen.

Subsequently, the emergency operation controller 12 decides whether or not a rescue operation for the lower car 3 is feasible in step S4 by the same method as that used in step S2; that is, the emergency operation controller 12 decides whether or not a condition: $LL_{min} \leqq L_n + L_1' \leqq LL_{max}$ or $LL_{min} \leqq L_n - L_1' \leqq LL_{max}$ is satisfied. If this condition is satisfied, the same operation as that performed in step S3 is performed to land the lower car 3 on the floor $F_2$ and the door 3*a* of the lower car 3 is opened in step S5. If this condition is not satisfied, any rescue operation is performed for the lower car 3 and a rescue operation for the lower car 3 is left to the work of maintenance servicemen. Then, double-deck elevator is set in a rescue waiting mode in step S6. After the completion of the rescue operation for the lower car 3, a query is made to see whether step S3 has been completed and the procedure goes to step S6 if step S3 has not been completed.

If it is decided in step S1 that data LL, LH, $L_n$ and $L_{n+1}$ necessary for the rescue operations are unavailable, the cars 2 and 3 are moved by the car space adjusting device 4 in the range between the upper limit height and the lower limit height to see whether or not the photoelectric devices 10*b* and 10*c* are able to detect the landing floor indicating plates 11*b* and 11*c*. If at least one of the photoelectric devices 10*b* and 10*c* is able to detect the corresponding landing floor indicating plate, the car provided with the photoelectric device that is able to detect the corresponding landing floor indicating plate is considered to have landed on the floor and the door of the car is opened in step S7 to let the passengers get out of the same car.

Although the invention has been described in its preferred embodiment with a certain degree of particularity, obviously many changes and variations are possible therein. It is therefore to be understood that the present invention may be practiced otherwise than as specifically described herein without departing from the scope and spirit thereof.

What is claimed is:

1. A double-deck elevator comprising:

a car support frame;

a winch for vertically moving the car support frame;

a first car supported on the car support frame and provided with a door;

a second car supported on the car support frame and provided with a door;

a car space adjusting device mounted on the car support frame and capable of adjusting a space between the first and the second car according to a floor height difference between two adjacent floors, to which the first and the second cars are to be landed; and an emergency operation controller that monitors a condition of the car space adjusting device and, when the car space adjusting device is unable to operate normally, operates the winch in order to move the car support frame vertically such that the first car and the second car are located at positions corresponding to a first floor and a second floor, to which the first and the second cars are able to be landed, respectively, and opens and closes the doors of the first and the second cars, according to at least one predetermined operating procedure.

2. The double-deck elevator according to claim 1, wherein the at least one operating procedure includes two operating procedures, and wherein the emergency operation controller compares a floor height difference between the first and the second floors and a distance between platforms of the first and the second car, and selects either one of the two operating procedures according to a result of comparison.

3. The double-deck elevator according to claim 2, wherein the emergency operation controller executes, when the absolute value of the floor height difference between the first and the second floors and the distance between the platforms of the first and the second cars is not greater than a predetermined value, an operating procedure including the steps of moving the car support frame such that the platform of the first car is leveled with the first floor and the platform of the second car is not leveled with the second floor or such that the platforms of both the first and the second cars are not leveled with the first and the second floors, respectively and opening the doors of both the first and the second cars.

4. The double-deck elevator according to claim 2, wherein the emergency operation controller executes, when the absolute value of the floor height difference between the first and the second floors and the distance between the platforms of the first and the second cars is greater than a predetermined value, an operating procedure including the steps of moving the car support frame such that the platform of the first car is leveled with the first floor, opening the door of the first car, closing the door of the first car, moving the car support frame such that the platform of the second car is leveled with the second floor, and opening the door of the second car.

5. The double-deck elevator according to claim 2, wherein the emergency operation controller executes, when it is impossible to determine the floor height difference between the first and the second floors and the distance between the platforms of the first and the second cars, an operating procedure comprising the steps of moving the car support frame such that the platform of the first car is leveled with the first floor, opening the door of the first car, closing the door of the first car, moving the car support frame such that the platform of the second car is leveled with the second floor and opening the door of the second car.

6. The double-deck elevator according to claim 3, wherein the predetermined value is 500 mm.

7. The double-deck elevator according to claim 1 further comprising:

passenger detectors for detecting passengers in the first and the second cars; and warning devices for advising passengers not to enter the cars or to get out of the cars;

wherein the emergency operation controller actuates each of the warning devices at least after the detection of no passenger in the car provided with the warning device after the door of the related car has been opened.

8. The double-deck elevator according to claim 7, wherein the emergency operation controller closes the door of the car after the detection of no passenger in the same car by the passenger detector after the door of the same car has been opened.

9. The double-deck elevator according to claim 7, wherein the passenger detectors are load measuring devices installed respectively on the first and the second cars, and the emergency operation controller decides that no passenger exists in the car when a value measured by the load measuring device installed on the same car is not greater than a predetermined value.

10. The double-deck elevator according to claim 9, wherein the predetermined value is 30 kg.

11. The double-deck elevator according to claim 7, wherein the passenger detectors are TV cameras and image processors that detects passengers on the basis of video signals provided by the TV cameras installed respectively in the first and the second cars, or man sensors installed respectively on the first and the second cars.

12. The double-deck elevator according to claim 1, wherein the emergency operation controller closes the door of each of the first and the second cars a predetermined time period after the door was opened.

13. The double-deck elevator according to claim 12, wherein the predetermined time period is five minutes.

14. The double-deck elevator according to claim 4 further comprising:

a passenger detector for detecting passengers in the first car; and an input device installed in the second car and used for entering an instruction to close the door of the first car;

wherein the emergency operation controller closes the door of the first car in a state where the door of the first car is open, the instruction to close the door of the first car is entered by operating the input device of the second car and the passenger detector detects no passenger in the first car.

15. The double-deck elevator according to claim 14, wherein load measuring devices installed respectively on the first and the second cars as the passenger detector, and the emergency operation controller decides that no passenger exists in the car when a value measured by the load measuring device installed on the same car is not greater than a predetermined value.

16. The double-deck elevator according to claim 15, wherein the predetermined value is 30 kg.

17. The double-deck elevator according to claim 14, wherein the passenger detectors are TV cameras and image processors that detects passengers on the basis of video signals provided by the TV cameras installed respectively in the first and the second cars, or man sensors installed respectively on the first and the second car.

18. The double-deck elevator according to claim 1 further comprising displays installed on the first and the second cars to display information about a progress of the operating procedure.

19. A double-deck elevator comprising:

a car support frame;

a winch for vertically moving the car support frame;

a first car supported on the car support frame and provided with a door;

a second car supported on the car support frame and provided with a door;

a car space adjusting device mounted on the car support frame and capable of adjusting a space between the first and the second car according to a floor height difference between two adjacent floors, to which the first and the second cars are to be landed; and an emergency operation controller that monitors a condition of the car space adjusting device and, when the car space adjusting device is unable to operate normally, operates the winch in order to move the car support frame vertically such that the first car is landed to a floor and the second car is landed to a floor.

20. A double-deck elevator comprising:

a car support frame;

a winch for vertically moving the car support frame;

a first car supported on the car support frame and provided with a door;

a second car supported on the car support frame and provided with a door;

a car space adjusting device mounted on the car support frame and capable of adjusting a space between the first and the second car according to a floor height difference between two adjacent floors, to which the first and the second cars are to be landed; and an emergency operation controller that monitors a condition of the winch and, when the winch is unable to operate normally, operates the car space adjusting device to move the first car and the second car vertically such that the first and the second cars are located at positions corresponding to a first floor and a second floor, to which the first and the second cars are landed, respectively, and opens and closes the doors of the first and the second cars.

21. The double-deck elevator according to claim 4, wherein the predetermined value is 500 mm.

22. The double-deck elevator according to claim 5, further comprising:

a passenger detector for detecting passengers in the first car; and an input device installed in the second car and used for entering an instruction to close the door of the first car;

wherein the emergency operation controller closes the door of the first car in a state where the door of the first car is open, the instruction to close the door of the first car is entered by operating the input device of the second car and the passenger detector detects no passenger in the first car.

23. The double-deck elevator according to claim 22, wherein load measuring devices installed respectively on the first and the second cars as the passenger detector, and the emergency operation controller decides that no passenger exists in the car when a value measured by the load measuring device installed on the same car is not greater than a predetermined value.

24. The double-deck elevator according to claim 23, wherein the predetermined value is 30 kg.

25. The double-deck elevator according to clam 22, wherein the passenger detectors are TV cameras and image processors that detects passengers on the basis of video signals provided by the TV cameras installed respectively in the first and the second cars, or man sensors installed respectively on the first and the second car.

* * * * *

UNITED STATES PATENT AND TRADEMARK OFFICE

CERTIFICATE OF CORRECTION

PATENT NO. : 6,786,305 B2
DATED : September 7, 2004
INVENTOR(S) : Kamimura et al.

It is certified that error appears in the above-identified patent and that said Letters Patent is hereby corrected as shown below:

Title page,
Items [22], [86] and [87] should read:

-- [22] PCT Filed: May 17, 2001
[86] PCT No.: PCT/JP01/04131

§ 371 (c)(1),
(2), (4) Date: May 6, 2002

[87] PCT Pub. No. WO 01/87756

PCT Pub. Date: Nov. 22, 2001 --

Signed and Sealed this

Fifteenth Day of March, 2005

JON W. DUDAS
*Director of the United States Patent and Trademark Office*